US007316342B2

(12) United States Patent
Chen

(10) Patent No.: US 7,316,342 B2
(45) Date of Patent: Jan. 8, 2008

(54) NAILING DEPTH CONTROL STRUCTURE FOR A PALM NAILER

(75) Inventor: Jing-Hung Chen, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/410,197

(22) Filed: Apr. 25, 2006

(65) Prior Publication Data

US 2007/0199970 A1 Aug. 30, 2007

(30) Foreign Application Priority Data

Feb. 24, 2006 (TW) ..... 95106477 A

(51) Int. Cl.
*B25C 7/00* (2006.01)

(52) U.S. Cl. ..... 227/142; 227/107

(58) Field of Classification Search ..... 227/109, 227/140, 107, 5, 142, 8; 81/429
See application file for complete search history.

(56) References Cited

U.S. PATENT DOCUMENTS

| | | | | |
|---|---|---|---|---|
| 2,940,488 | A * | 6/1960 | Riley, Jr. | 81/429 |
| 3,460,408 | A * | 8/1969 | Raymond | 408/112 |
| 3,527,273 | A * | 9/1970 | Falter | 81/429 |
| 4,592,257 | A * | 6/1986 | Durr | 81/429 |
| 5,044,233 | A * | 9/1991 | Tatsu et al. | 81/429 |
| 5,219,110 | A * | 6/1993 | Mukoyama | 227/8 |
| 5,524,512 | A * | 6/1996 | Wolfe | 81/429 |
| 5,601,387 | A * | 2/1997 | Sanford et al. | 408/113 |
| 6,499,381 | B2 * | 12/2002 | Ladish et al. | 81/429 |
| 6,578,750 | B2 * | 6/2003 | Kubo et al. | 227/142 |
| 6,581,815 | B1 * | 6/2003 | Ho et al. | 227/142 |
| 6,598,775 | B1 * | 7/2003 | Chen | 227/113 |
| 6,695,192 | B1 * | 2/2004 | Kwok | 227/8 |
| 6,851,595 | B1 * | 2/2005 | Lee | 227/142 |
| 6,932,261 | B2 * | 8/2005 | Huang | 227/120 |
| 7,032,797 | B2 * | 4/2006 | Liao | 227/142 |

FOREIGN PATENT DOCUMENTS

| | | | |
|---|---|---|---|
| JP | 9-109063 A | * | 4/1997 |
| JP | 9-201781 A | * | 8/1997 |

* cited by examiner

*Primary Examiner*—Stephen F. Gerrity
(74) *Attorney, Agent, or Firm*—Egbert Law Offices

(57) ABSTRACT

The nailing depth control structure for a palm nailer is mounted at the hammering head of the palm nailer. The control structure includes a control block with several steps, a cylinder base, a flexible pipe fitted internally with an anchoring position, a resilient component and a rotary location component. When the user employs the present invention, it is possible to drive the synchronous rotation of flexible pipe and change the position of anchoring position of flexible pipe in relation to steps of control block, thereby adjusting retracted distance of flexible pipe for easy control of nailing depth. By using scale markers placed externally at the cylinder base, it is feasible to identify the current nailing depth of palm nailer, and relieve the need of removing structural components with improved efficiency and ease-of-operation.

10 Claims, 15 Drawing Sheets

NAILING DEPTH CONTROL STRUCTURE FOR A PALM NAILER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a palm nailer, and more particularly to an innovative palm nailer with a nailing depth control structure.

BACKGROUND OF THE INVENTION

Unlike a conventional nailer, the palm nailer of the present invention is a pneumatic handheld nailing tool, which is specifically designed with a holding position for the palm. With the exclusion of the nailing spike, this structure is provided with a single nailing body that is fixed into a work piece by means of hammering.

The structure of a prior art palm nailer is illustrated in FIG. 1, wherein the bottom of nailer body 10 is screwed with an extension sleeve 11, and wherein the bottom of the extension sleeve 11 is fitted with a flexible pipe 12. A spring 14 is mounted between the top of the flexible pipe 12 and shoulder 13 of nailer body 10, such that the flexible pipe 12 can extend out flexibly. Referring to FIG. 1, when the palm nailer is employed, the nailing body 16 will be driven into work piece (A) synchronously with the hammer axle 15, such that the flexible pipe 12 draws back into extension sleeve 11.

Moreover, manual control shall be required if the user is intended to keep the nail head leveled, depressed or protruded (i.e. nailing depth) when hammering the nailing body 16 into the work piece (A); however, this nailing process requires skilled operation. Operators with poor experience will likely lead to inconsistent hammering of the nailing body 16, reducing engineering quality.

To overcome the above-specified shortcomings, the prior art provides another palm nailer as illustrated in FIG. 2. It has the same structural components as in FIG. 1, i.e. a nailer body 20, an extension sleeve 21, a flexible pipe 22 and a spring 23. The improved efficacy lies in that, a plurality of belleville springs 25 are additionally mounted between screw terminal 211 of extension sleeve 21 and a clamping surface 241 within screwing slot 24 of nailer body 20. Depending upon the number of belleville springs 25, it is possible to adjust the depth of nailing the screw terminal 211 of extension sleeve 21 into screwing slot 24, thereby changing the maximum length (L) of flexible pipe 22 protruding from the nailer body 20. Given a constant maximum stroke of the hammer axle 26 of a palm nailer, the relative distance between bottom of hammer axle 26 and bottom of flexible pipe 22 can be adjusted according to the protruding length of aforesaid flexible pipe 22, as shown in FIGS. 2, 3.

Referring also to FIG. 2, belleville springs 25 (two springs) are embedded between screw terminal 211 of extension sleeve 21 and screwing slot 24 of nailer body 20. In such a case, there is a larger distance between the bottom of hammer axle 26 and bottom of flexible pipe 22. Alternatively, when the flexible pipe 22 is retracted into a stationary state (as illustrated in FIG. 3), the bottom of hammer axle 26 is flush with bottom of flexible pipe 22, namely, nail head 271 of nailing body 27 is flush with the surface of work piece (A). Referring also to FIG. 4, only a single belleville spring 25 (one spring) is embedded between screw terminal 211 of extension sleeve 21 and screwing slot 24 of nailer body 20. If the flexible pipe 22 is retracted into a stationary state when the distance between bottom of hammer axle 26 and bottom of flexible pipe 22 becomes shorter, the bottom of hammer axle 26 will override the distance of a single belleville spring 25 downwards from the bottom of flexible pipe 22, thus making the nail head 271 of nailing body 27 embedded into the surface of work piece (A). As compared to the conventional structure illustrated in FIG. 1, the palm nailer provides the technological feature of belleville spring 25.

This prior art structure also has problems during applications. For example, after the belleville spring 25 is embedded between screw terminal 211 of extension sleeve 21 and screwing slot 24 of nailer body 20, the user cannot visualize directly the number of belleville spring 25 as the number is hidden within the nailer body 20. And, it is also difficult to identify the appearance due to little variance of protrusion of extension sleeve 21 (to the maximum extent of the thickness of several belleville springs). For this reason, the next user must remove the extension sleeve 21 and open the screwing slot 24 of nailer body 20, such that the user can visualize the number of belleville spring 25 and adjust a suitable nailing depth, leading to inconvenience of operation. In addition, since the extension sleeve 21 is screwed into screwing slot 24 of the nailer body 20, loosening or screwing can be achieved only through a slow rotating process in an inefficient way.

Thus, to overcome the aforementioned problems of the prior art, it would be an advancement in the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

As compared to prior art, the present invention has enhanced efficacy. In the prior art, the nailing depth of a common palm nailer is controlled with a structural design of belleville springs that is mounted between a screw terminal of the extension sleeve and screwing slot of a nailer body. However, it has disadvantages of difficult identification and inconvenient operation due to required removal of extension sleeve.

The present invention includes a special structure comprising a control block 40 with several steps, a cylinder base 50, a flexible pipe 60 fitted with an anchoring position 65, a resilient component 70 and a rotary locating component 80. When the user employs the present invention, it is possible to drive the synchronous rotation of flexible pipe 60 by quickly rotating the cylinder base. So, the position of anchoring position 65 is allowed to change within the flexible pipe 60 in relation to step 41, 42, 43 of control block 40, thereby adjusting a retracted distance of flexible pipe 65 for control of nailing depth (i.e. nail head is protruded, flush or retracted). By using scale markers D1, D2 (as illustrated in FIG. 21) placed externally at a cylinder base 50, it is feasible to identify the current nailing depth of palm nailer, and relieve the need of removing structural components with improved efficiency.

As a whole, the nailing depth control structure for a palm nailer of the present invention can improve efficiently the shortcomings of conventional structures and provide a simple operation and identification.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Referring to FIGS. 5, 6, 7, 8, 9, the nailing depth control structure of palm nailer has the present detailed description of the present invention based on a typical preferred embodiment. Although the invention has been explained in relation to a preferred embodiment, it is to be understood that many other possible modifications and variations can be made without departing from the spirit and scope of the invention as hereinafter claimed.

Figure 1:
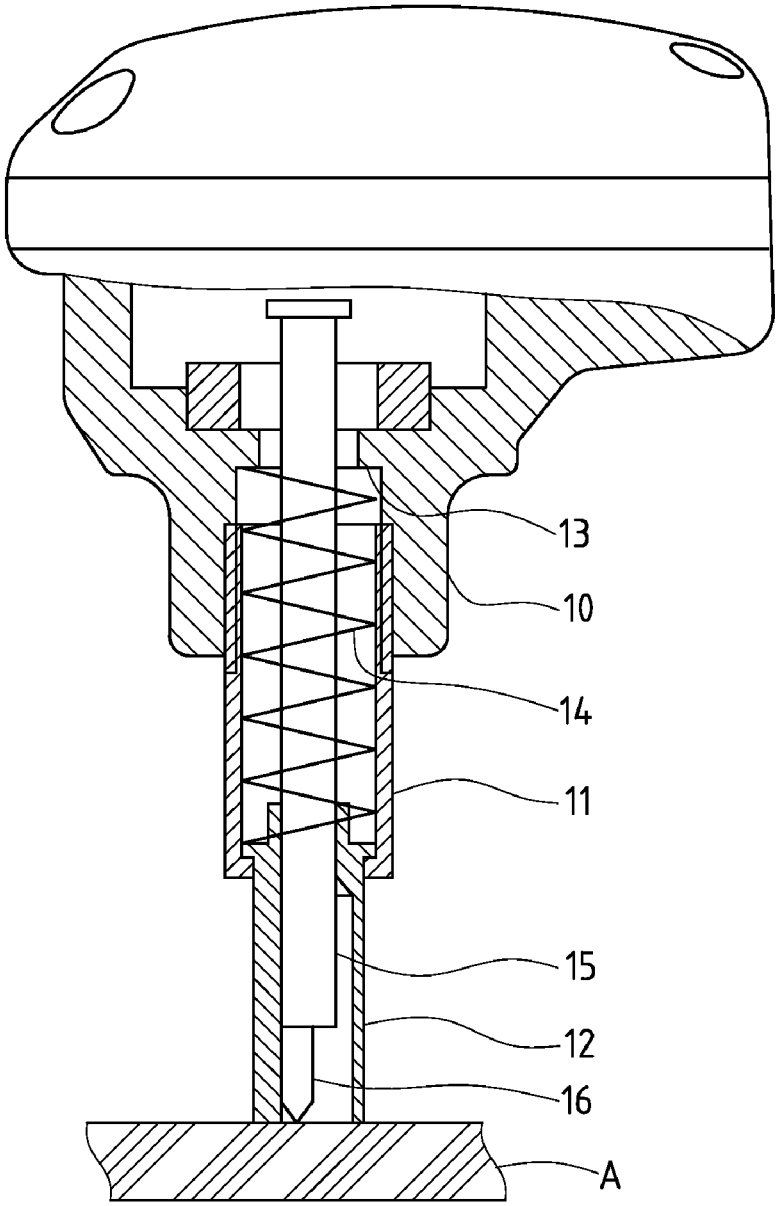
FIG.1 PRIOR ART
FIG. 1 shows a vertical cross-sectional view of the conventional palm nailer.
Figure 2:
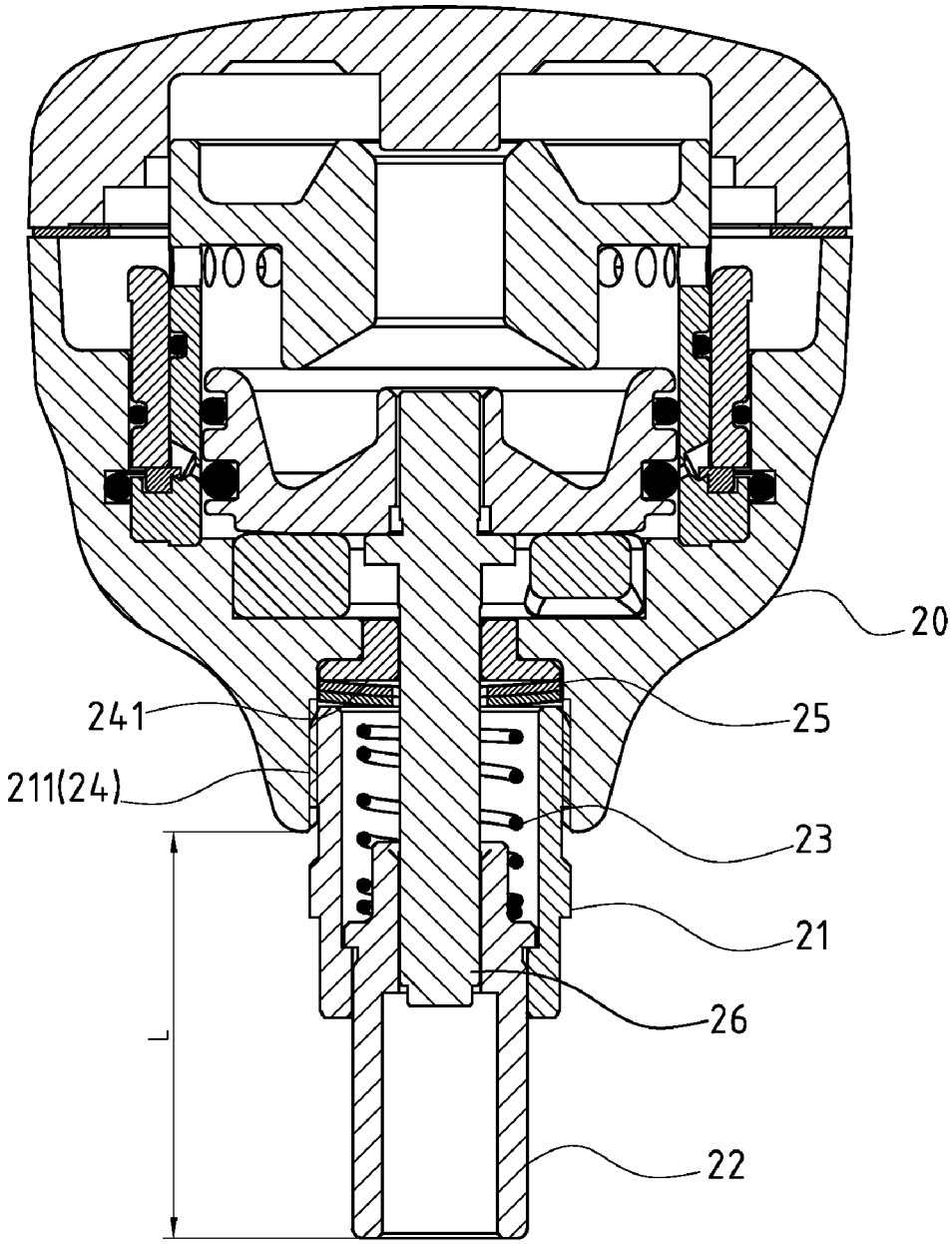
FIG.2 PRIOR ART
FIG. 2 shows an alternate cross-sectional view of the conventional palm nailer.
Figure 4:
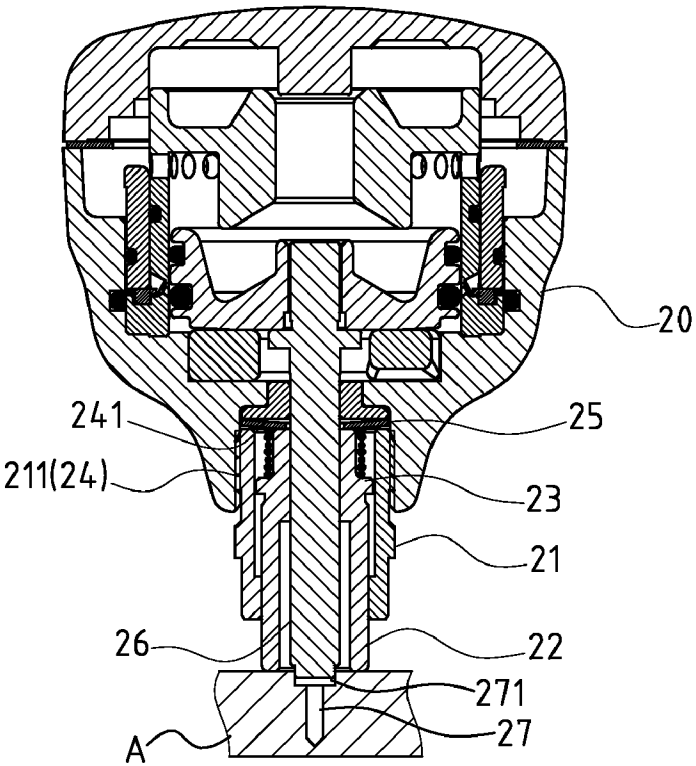
FIG.4 PRIOR ART
FIGS. 3-4 show the cross-sectional views, similar to FIG. 2, of the conventional palm nailer in operation.
Figure 3:
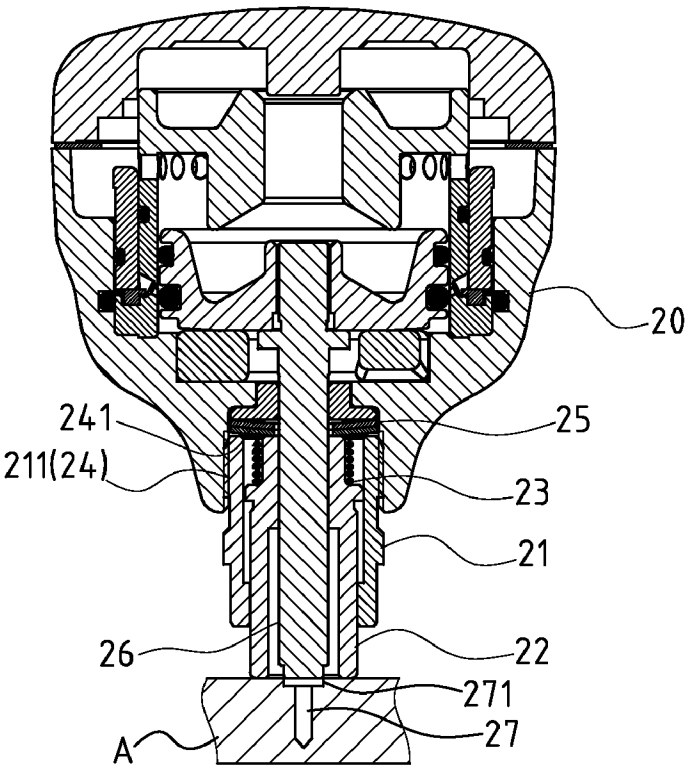
FIG.3 PRIOR ART
Figure 5:
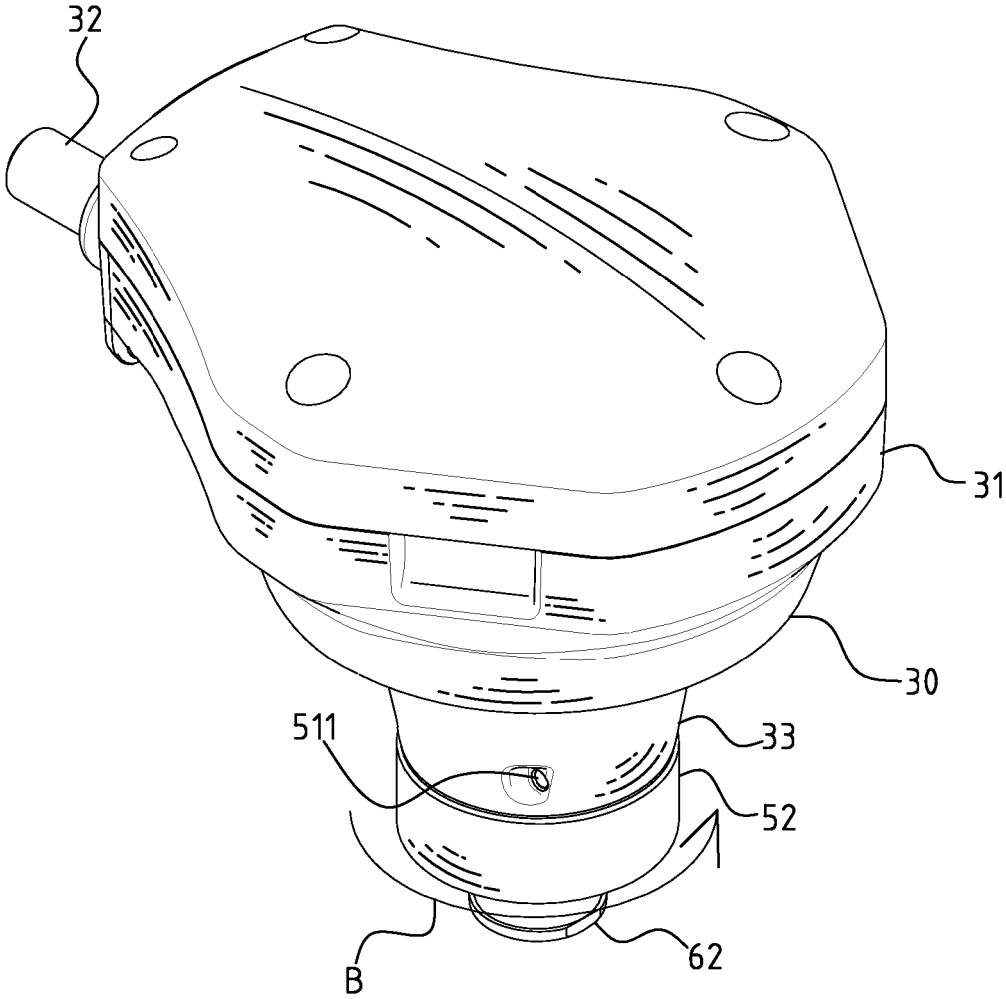
FIG. 5 shows a perspective view of the exterior of the present invention.
Figure 6:
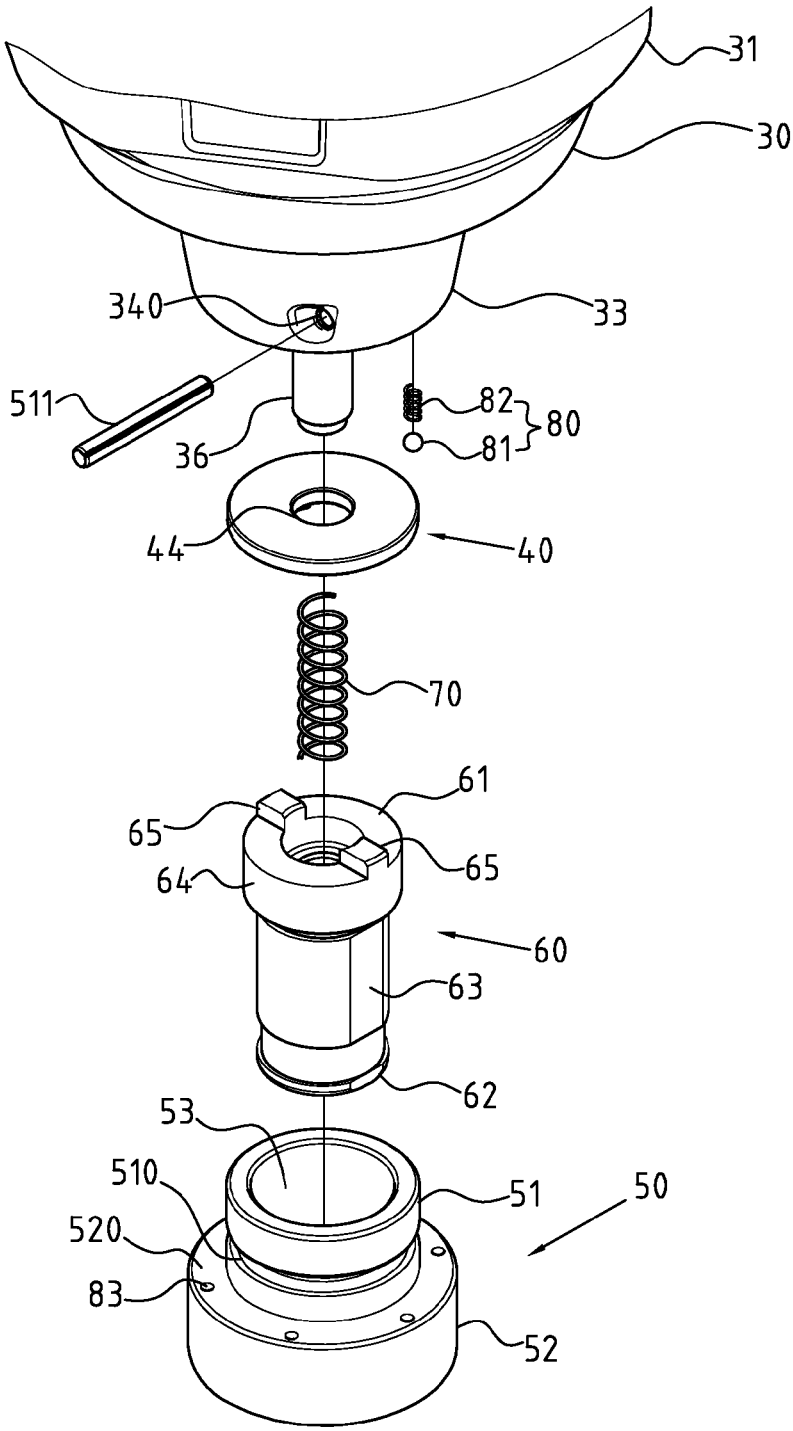
FIG. 6 shows an exploded perspective view of the exterior of the present invention extending downwardly from above.
Figure 7:
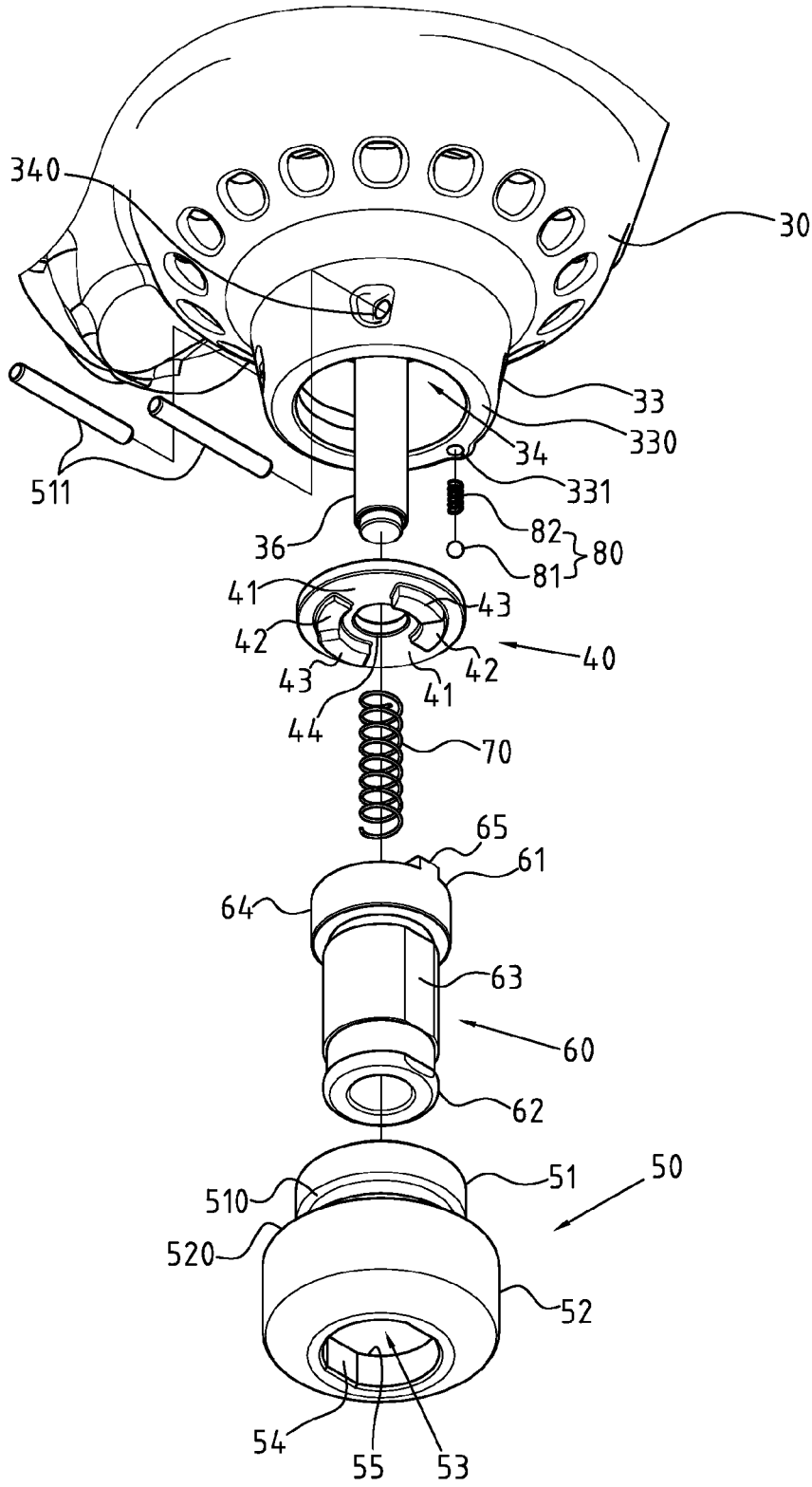
FIG. 7 shows an exploded perspective view of the exterior of the present invention from extending upwardly from below.
Figure 8:
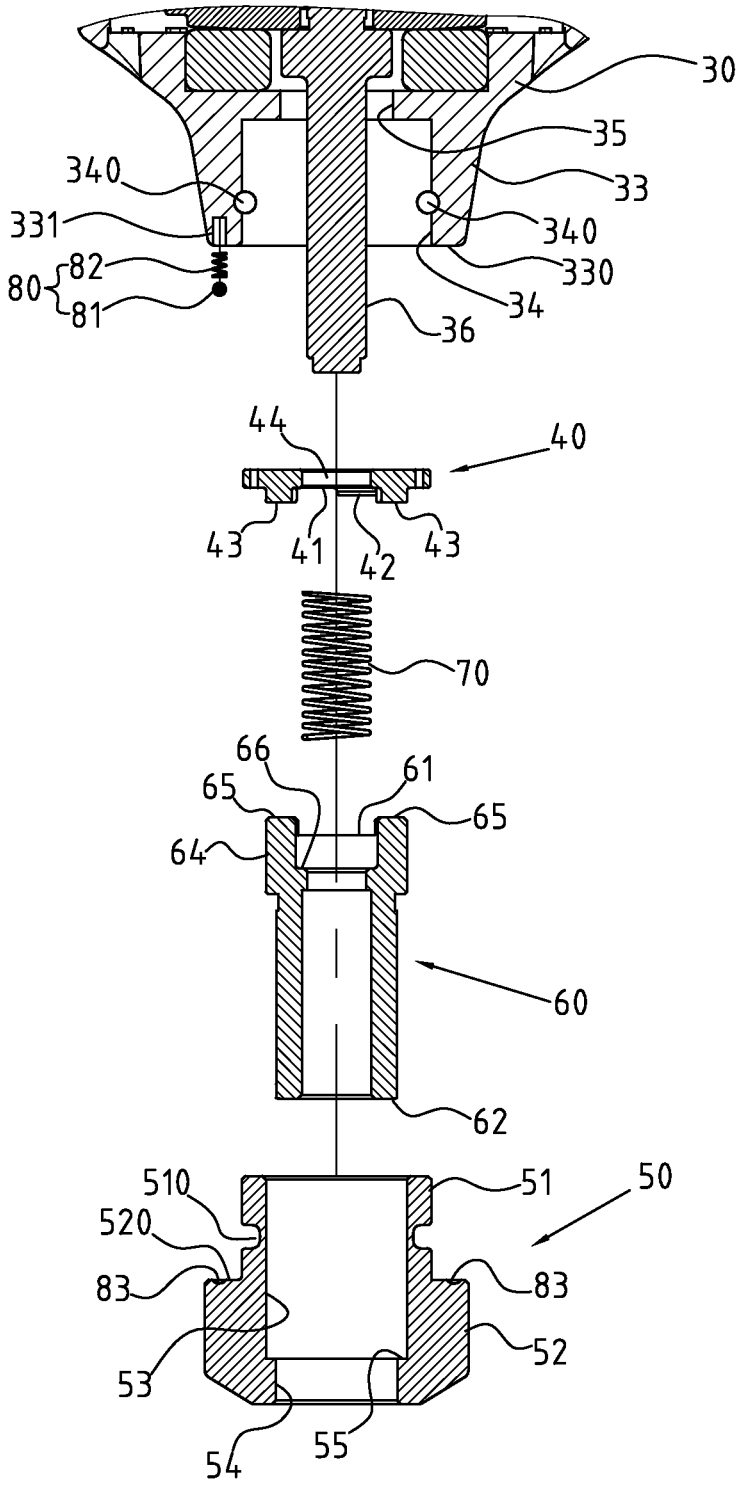
FIG. 8 shows an exploded sectional view of the present invention.

A palm nailer generally comprises a palm nailer body 30, as shown in FIG. 5, which comprises a holding portion 31, an air inlet 32 and a hammering head 33. The hammering head 33 is provided with an assembly slot 34, which has a through hole 35 for protruding of a hammer axle 36 within hammering head 33.

The invention also includes a control block 40, which is placed into assembly slot 34 of hammering head 33. At least two steps are placed externally onto control block 40 along a preset peripheral line. In this preferred embodiment, two groups of steps (i.e. first step 41, second step 42 and third step 43) are arranged externally onto control block 40 at two projecting blocks of 180° oppositely curved surfaces. This control block 40 is also provided with a through hole 44 for a protruding of hammer axle 36 at opposite site of through hole 35 within assembly slot 34 of hammering head 33. The control block 40 of the embodiment is fabricated into a disc body, which is securely positioned (e.g. snapping, sleeving and screwing) onto an inner wall of the assembly slot 35 of hammering head 33.

The cylinder base 50 comprises an abutting end 51 and a controlling end 52, of which the abutting end 51 is flexibly mounted into assembly slot 35 of hammering head 33. As shown in the preferred embodiment, abutting end 51 is provided with a ring groove 510, such that hammering head 33 allows radial threading of two separated pins 511. Two pins 511 pass through pinhole 340 at both ends of assembly slot 34 of hammering head 33 and then extend through the aforesaid ring groove 510, thereby enabling the cylinder base 50 to rotate without exceeding the limit. The controlling end 52 of the cylinder base 50 is located externally at hammering head 33 to manual control, besides, a through hole 53 is placed at the center of cylinder base 50, with the inner end of through hole 53 located at opposite side of control block 40.

The inner end 61 of flexible pipe 60 is directionally mounted onto through hole 53 of cylinder base 50, such that flexible pipe 60 can slide axially only along the through hole 53 with spacing limitation, and enable synchronous rotation of flexible pipe 60 with cylinder base 50. The outer end 62 of flexible pipe 60 protrudes from through hole 53 of cylinder base 50. For the above-specified directional assembly, the preferred embodiment allows the periphery of flexible pipe 60 and through hole 53 of cylinder base 50 to form a coupled sliced surface 63, 54. The flexible pipe 60 can slide axially only along the through hole 53 for directional assembly. For the spacing of flexible pipe 60, a ring flange 64 is mounted at inner end 61 of the flexible pipe 60, while a shoulder 55 is placed externally at through hole 53 of cylinder base 50 for anchoring of ring flange 64. An anchoring position 65 is placed at step 41, 42, 43 of control block corresponding to inner end 61 of flexible pipe 60. In this preferred embodiment, the anchoring position 65 and step 41, 42, 43 of control block 40 form two groups of 180° oppositely projecting blocks.

A resilient component 70 refers to a spring in this preferred embodiment. The resilient component 70 is mounted between outer face of control block 40 and a shoulder 66 at inner end 61 of flexible pipe 60. So, flexible pipe 60 can extend out flexibly, thus making outer face 62 of flexible pipe 60 protruding (as illustrated in FIG. 9).

A rotary locating component 80 is located with the rotation of cylinder base 50. The rotary locating component 80 of the preferred embodiment comprises a flexible ball 81 fitted at outer face 330 of hammering head 33 of palm nailer body 30, as well as several locating grooves 83 alternatively arranged at an inner ring surface 520 of controlling end 52 of cylinder base 50. The flexible ball 81 can yield a flexible supporting force via a spring 82, while spring 82 and flexible ball 81 can be fitted into a tank 331 at outer face 330 of hammering head 33.

Based upon aforementioned structural design, the operation of the present invention is described below.

Figure 9:
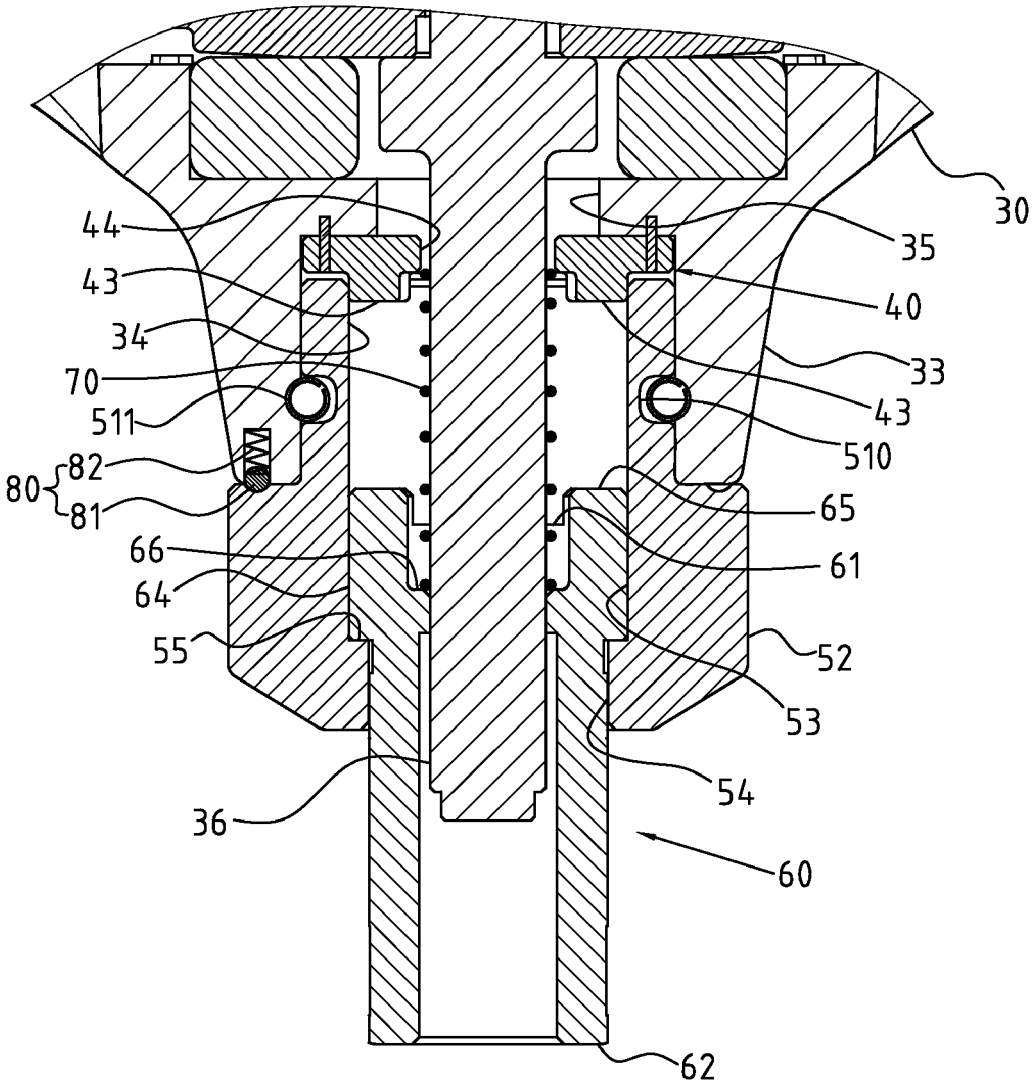
FIG. 9 shows an assembled sectional view of the present invention with extended flexible pipe.
Figure 10:
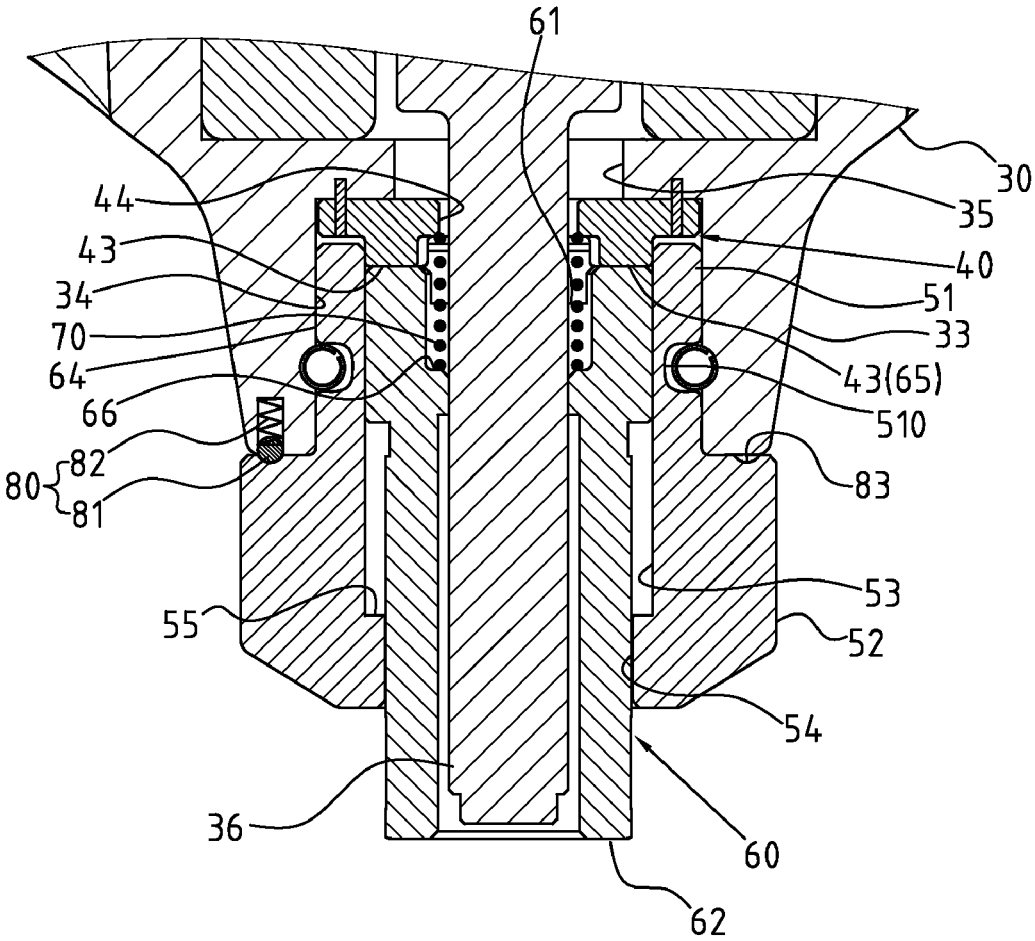
FIG. 10 shows another assembled sectional view of the present invention with retracted flexible pipe.

Firstly, the present invention drives the synchronous rotation of flexible pipe 60 by rotating quickly the cylinder base 50 (as shown by Arrow B of FIG. 5) (this operation is conducted when flexible pipe 60 is extended as illustrated in FIG. 9). In this way, it is possible to change the position of anchoring position 65 within flexible pipe 60 in relation to step 41, 42, 43 of control block 40, thereby adjusting retracted distance of flexible pipe 60 for control of nailing depth. The following paragraphs describe how anchoring position 65 of flexible pipe 60 moves with different rotating angles of cylinder base 50 and relative position of steps of control block 40.

Figure 11:
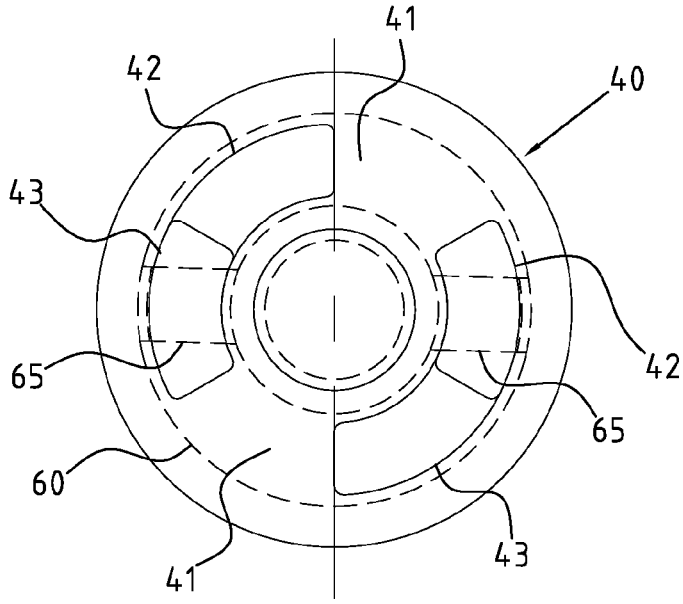
FIG. 11 shows an upward elevation view of the control block and anchoring position of the present invention.
Figure 12:
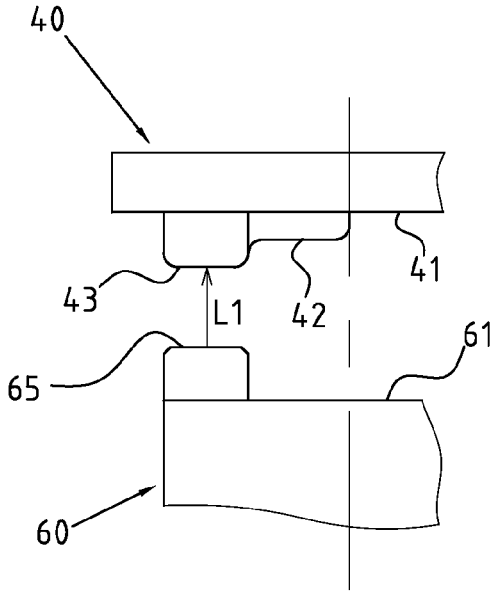
FIG. 12 shows a partial side elevation view of FIG. 11.
Figure 17:
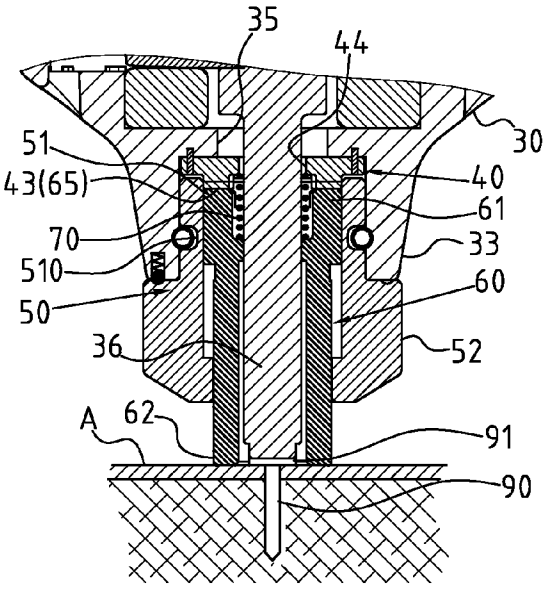

Referring to FIGS. 11, 12 (also referring to FIG. 7), when the user drives the synchronous rotation of flexible pipe 60 by rotating cylinder base 50, the anchoring position 65 is rightly located at third step 43 of control block 40. In such case, the retraction stroke of flexible pipe 60 is L1 as shown in FIG. 12. When the flexible pipe 60 is retracted to a stop position (as shown in FIG. 17), the outer face 62 is lower than the lowest point of hammer axle 36 about a nail head. So, when the nailing body 90 is hammered into work piece (A), the projecting state of nail head 91 can be guaranteed.

Figure 13:
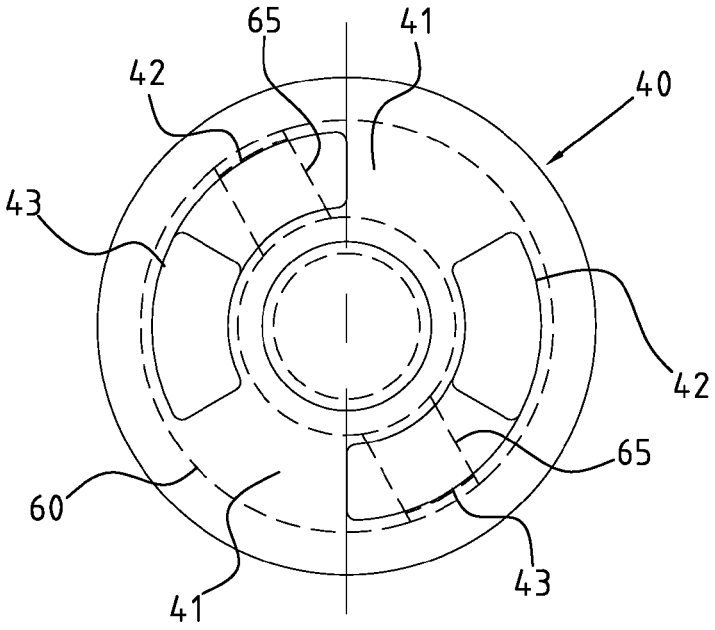
FIG. 13 shows another upward elevation view of the control block and anchoring position of the present invention.
Figure 14:
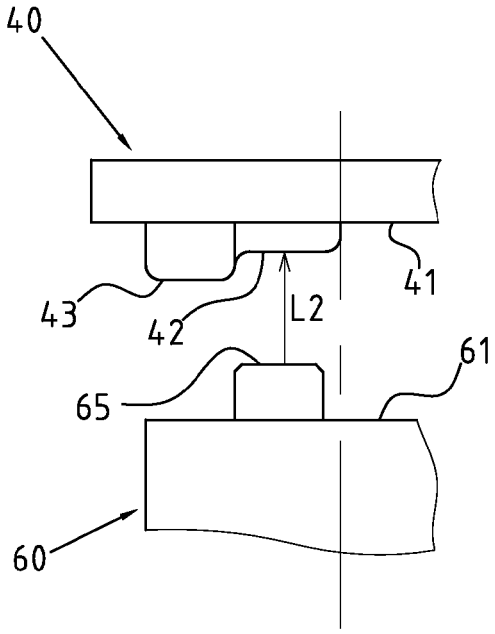
FIG. 14 shows another partial side elevation view of FIG. 13.
Figure 18:
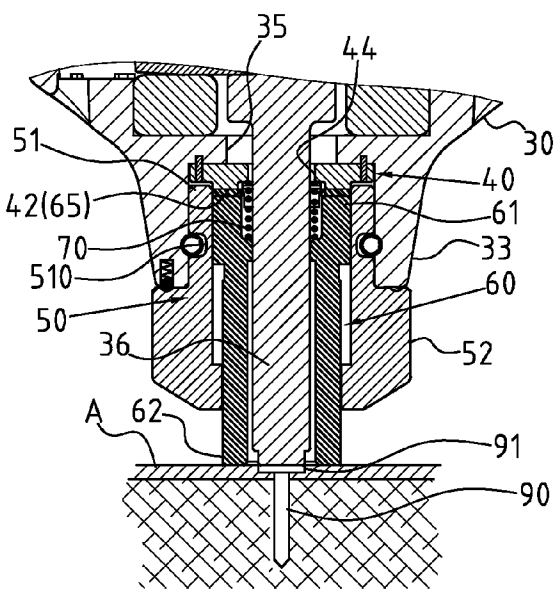

Referring to FIGS. 13, 14 (also referring to FIG. 7), when the user drives the synchronous rotation of flexible pipe 60 by rotating cylinder base 50, the anchoring position 65 is rightly located at second step 42 of control block 40. In such case, the retraction stroke of flexible pipe 60 is L2 as shown in FIG. 12. When the flexible pipe 60 is retracted to a stop position (as shown in FIG. 18), the outer face 62 is flush with the lowest point of hammer axle 36. So, when the nailing body 90 is hammered into work piece (A), the nail head 91 is flush with the surface of work piece (A).

Figure 15:
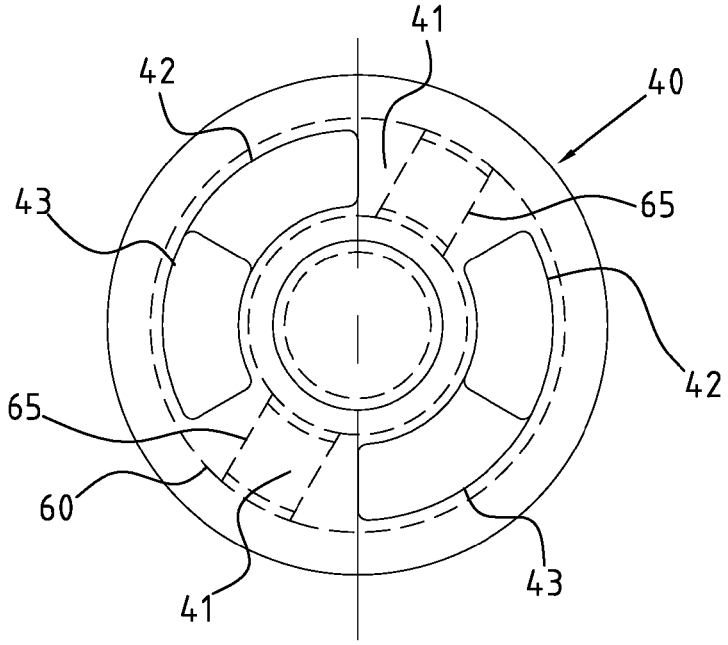
FIG. 15 shows another upward elevation view of the control block and anchoring position of the present invention.
Figure 16:
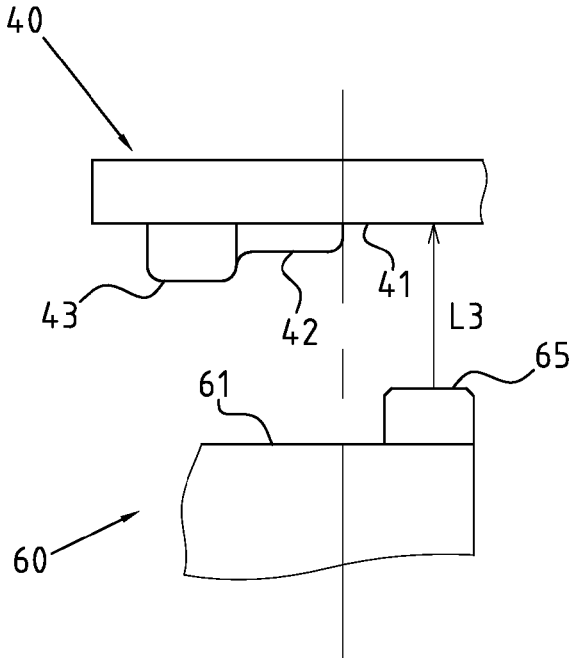
FIG. 16 shows a partial side elevation view of FIG. 15.
Figure 19:
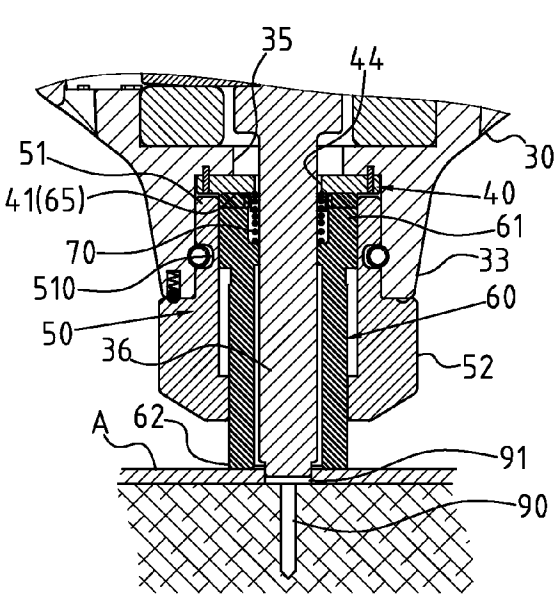
FIGS. 17-19 show the sectional views of the flexible pipe of the present invention in a retracting state.

Referring to FIGS. 15, 16 (also referring to FIG. 7), when the user drives the synchronous rotation of flexible pipe 60 by rotating cylinder base 50, the anchoring position 65 is rightly located at first step 41 of control block 40. In such case, the retraction stroke of flexible pipe 60 is L3 as shown in FIG. 12. When the flexible pipe 60 is retracted to a stop position (as shown in FIG. 19), the outer face 62 is higher than the lowest point of hammer axle 36 about a nail head. So, when the nailing body 90 is hammered into work piece (A), the nail head 91 is in a depressed state.

Figure 20:
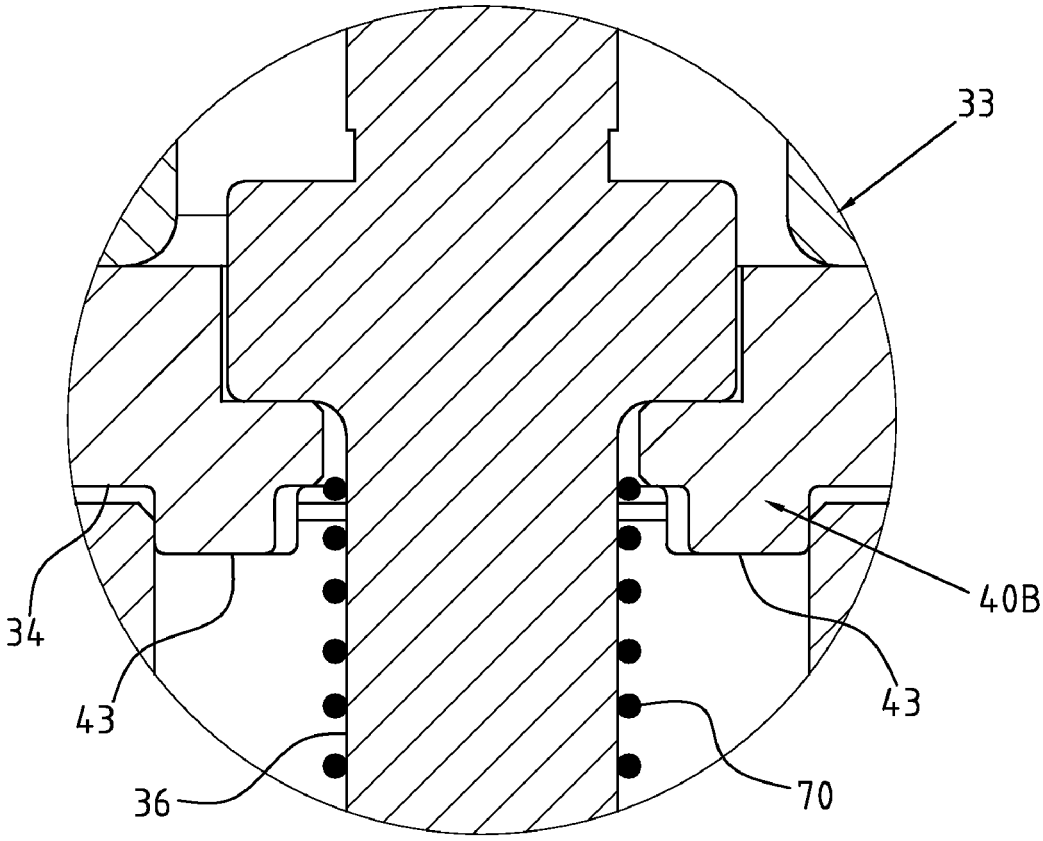
FIG. 20 shows an isolated sectional view of the embodiment of the control block of the present invention.

Referring also to FIG. 20, the control block 40B can also be integrally preformed into assembly slot 34 of hammering head 33.

Figure 21:
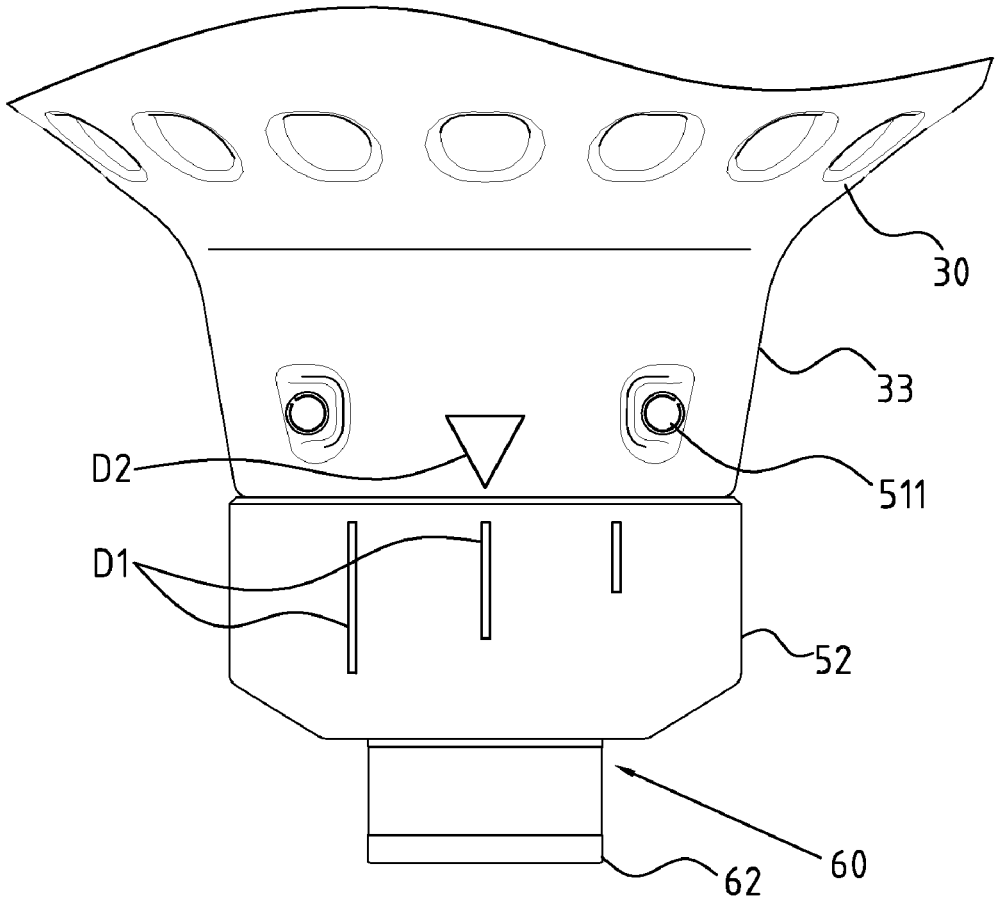
FIG. 21 shows an elevation view of the embodiment of the controlling end and external of the hammering head of the present invention with scale markers.

Referring also to FIG. 21, scale markers D1, D2 are placed externally at controlling end 52 of cylinder base 50 and hammering head 33 of palm nailer body 30, thus helping identify the rotating angle of cylinder base 50. Scale marker D2 is a triangular sign, and scale marker D1 is an alternatively arranged pattern of different sizes (to represent different nailing depths). In such a way, when scale marker D1 is coupled with scale marker D2, this pattern enables the user to identify easily the current nailing depth of palm nailer.

I claim:

1. A palm nailing apparatus comprising:

a body having a hammering head with an assembly slot extending through an interior thereof;

a control block positioned in said assembly slot of said hammering head, said control block having a discoidal shape with a surface facing outwardly of said assembly slot, said surface having steps extending outwardly of said surface, each of said steps being spaced inwardly from a periphery of said control block;

a cylinder base having an abutting end and a controlling end, said abutting end being mounted into said assembly slot so as to abut said control block in the space between said periphery and said steps, said controlling end extending outwardly of said hammering head, said cylinder base having a through hole extending therethrough at a center thereof, and inner end of said through hole positioned at said surface of said control block;

a flexible pipe mounted in said through hole of said cylinder base, said flexible pipe slidable axially along said through hole of said cylinder base, said flexible pipe having an anchoring position projecting from an end thereof, said anchoring position aligned with one of said steps, said flexible pipe having an opposite end protruding outwardly of an outer end of said cylinder base, said flexible pipe having a shoulder formed on a through hole extending axially therethrough; and a resilient member extending between said shoulder and said surface of said control block or a surface of said cylinder base.

2. The apparatus of claim 1, said control block being integrally formed in said assembly slot of said hammering head.

3. The apparatus of claim 1, said steps comprising:

a first set of steps formed on one side of said surface; and a second set of steps formed on an opposite side of said surface, each of said first and second sets of steps having a first step extending outwardly of said surface by a distance greater than a distance that a second step extends outwardly of said surface, said first step of said first set being radially spaced by approximately 180° from said first step of said second set of steps, said second step of said first set of steps being radially spaced by approximately 180° from said second step of said second set of steps, said anchoring position abutting one of said first and second steps of said first and second set of steps.

4. The apparatus of claim 1, said cylinder base having a ring groove extending therearound between said abutting end and said controlling end, said hammering head having a pair of holes extending therethrough, the apparatus further comprising:

a pair of pins respectively received by said pair of holes, said pair of pins each having a portion received in said ring groove so as to allow said cylinder base to rotate relative to said hammering head.

5. The apparatus of claim 1, said flexible pipe having a ring flange at said end thereof, said cylinder base having a shoulder formed inwardly from an inner wall of said through hole of said cylinder base.

6. The apparatus of claim 1, said flexible pipe having a sliced surface formed on an exterior surface thereof, said cylinder base having a sliced surface formed on an inner wall of said through hole of said cylinder base, said sliced surfaces slidably contacting each other such that said flexible pipe is rotatable synchronously with said cylinder base.

7. The apparatus of claim 1, said resilient element being a spring depth.

8. The apparatus of claim 1, further comprising:

a rotary locating means positioned on an end of said hammering head for rotating and positioning said cylinder base with respect to said hammering head.

9. The apparatus of claim 8, said rotary locating means comprising:

a flexible ball fitted to said end of said hammering head; and a plurality of locating grooves formed on an inner ring surface of said controlling end of said cylinder base.

10. The apparatus of claim 1, further comprising:

a plurality of scale markers placed externally on said cylinder base and on said hammering head.

* * * * *